US009504618B2

(12) United States Patent
Lykkegaard

(10) Patent No.: US 9,504,618 B2
(45) Date of Patent: Nov. 29, 2016

(54) JACK, ESPECIALLY FOR THE CHANGE OF THE POSITION OF THE SEAT BASE IN A WHEELCHAIR

(71) Applicant: REAC Poland Sp. z o.o., Piotrkow Trybunalski (PL)

(72) Inventor: Frank Lykkegaard, Monaco (FR)

(73) Assignee: REAC POLAND SP. Z O.O., Piotrkow Trybunaiski (PL)

( * ) Notice: Subject to any disclaimer, the term of this patent is extended or adjusted under 35 U.S.C. 154(b) by 0 days.

(21) Appl. No.: 14/881,823

(22) Filed: Oct. 13, 2015

(65) Prior Publication Data

US 2016/0106607 A1 Apr. 21, 2016

(30) Foreign Application Priority Data

Oct. 21, 2014 (PL) ..... P409873

(51) Int. Cl.

| | |
|---|---|
| ***A61G 5/00*** | (2006.01) |
| ***A61G 5/10*** | (2006.01) |
| ***A61G 5/14*** | (2006.01) |
| *A61G 5/04* | (2013.01) |

(52) U.S. Cl.

CPC ..... *A61G 5/1059* (2013.01); *A61G 5/14* (2013.01); *A61G 5/043* (2013.01); *A61G 5/1075* (2013.01)

(58) Field of Classification Search

CPC ..... A61G 5/1059; A61G 5/14; A61G 5/043; A61G 5/1075

USPC ..... 248/421, 588, 550; 297/338

See application file for complete search history.

(56) References Cited

U.S. PATENT DOCUMENTS

| | | | | |
|---|---|---|---|---|
| 3,785,462 | A * | 1/1974 | Coad | B66F 7/065 187/262 |
| 5,169,112 | A * | 12/1992 | Boyles | B60N 2/501 248/406.2 |
| 5,305,482 | A | 4/1994 | Dewert | |
| 5,481,769 | A | 1/1996 | Schneider | |
| 7,341,310 | B1 * | 3/2008 | Ross | A47C 3/36 297/344.12 |
| 7,552,683 | B2 * | 6/2009 | Hayashi | B62D 65/18 104/89 |
| 8,888,070 | B2 * | 11/2014 | Olesen | A61G 5/1059 187/211 |
| 2006/0087166 | A1 * | 4/2006 | Trippensee | A61G 5/043 297/338 |
| 2007/0034125 | A1 * | 2/2007 | Lo | B66F 7/0608 108/145 |
| 2007/0084648 | A1 * | 4/2007 | DuFresne | A61G 5/1059 180/65.1 |
| 2010/0224841 | A1 | 9/2010 | Liljedahl | |
| 2014/0262566 | A1 * | 9/2014 | Davis | A61G 5/1056 180/54.1 |

FOREIGN PATENT DOCUMENTS

| | | |
|---|---|---|
| DE | 3228834 | 2/1984 |

OTHER PUBLICATIONS

Polish Search Report dated Apr. 2, 2015 from corresponding Application No. P.409873.

* cited by examiner

*Primary Examiner* — Anita M King
(74) *Attorney, Agent, or Firm* — Katten Muchin Rosenman LLP

(57) ABSTRACT

Disclosed here is a jack for the change of a position of the seat base in a wheelchair. The jack has, in the lower frame (1), the driving system of the screw jack with a vertical screw (14) is fixed; and the upper end of the screw (14) is pivotally fixed in the main arms (3) of the scissors system. The driving system of the screw (14) of the screw jack is fixed to the base (11) attached slideably to the lower frame (1) in the tracks (8) in such a way that the screw (14) is permanently in a perpendicular position to the lower frame (1) and the upper frame (2) with maximum deviation of ±10°; and the base (11) is driven by the arms (17), with their first ends fixed pivotally in the main arms (3), and the other ends fixed pivotally in the base (11).

6 Claims, 3 Drawing Sheets

JACK, ESPECIALLY FOR THE CHANGE OF THE POSITION OF THE SEAT BASE IN A WHEELCHAIR

FIELD OF THE INVENTION

The subject of the invention is a jack used mainly in wheelchairs for the change of the position of the seat base, and thus the change of the position of a person in the wheelchair.

BACKGROUND

In wheelchairs for the elderly or the disabled, movable (raising/lowering) seat bases are used to improve the mobility of their users. From the patent description no. WO0021478 there is known a jack intended for the change of the position of the seat base in wheelchairs, in which a horizontal frame of the seat base comprises a lower and upper part. The lower part is fixed to the wheelchair in a rigid way, and the upper part is movable and moves upwardly and downwardly. The movement of the upper frame is possible due to the operation of the arms of the scissors jack joining both frames. The scissors jack is driven by an electric servomotor, with one end fixed pivotally in a lower frame, and the other end fixed in one pair of arms. When the piston comes out, the upper frame goes up, and when the piston goes back, the return movement takes place. Both frames are permanently parallel to each other, the scope of the movement upwards is regulated by the advance movement of the piston. After the piston goes back, the frames make a compact flat block. On the upper surface of the block there is a proper soft seat base, which is fixed to the upper frame.

From the description of the Polish invention no. P.397089 there is known a scissors jack, in which the drive of the rising scissors mechanism is a servomotor fixed pivotally on a bolt in the lower frame; the other end is fixed pivotally on a bolt in the lever, which is permanently fixed to a pivot fixed pivotally in the lower frame. On the pivot there are permanently fixed cams of the rising system. Cams have some recesses where the bolt can move; the bolt is permanently fixed to a driving arm of the scissors jack. The folded jack has a form of a thin flat block; its fault is a complicated construction of the lever and cam system.

SUMMARY

According to the invention, a driving system of the screw jack with a vertical screw is fixed in the lower frame; and the upper end of the screw is fixed pivotally in the main arms of the scissors system. The driving system of the screw in the screw jack is fixed to the base positioned in the lower frame so that the base can slide along the tracks, and the screw is permanently perpendicular to the lower frame and the upper frame with maximum deviation of ±10°. The base is driven by the arms, with their first ends fixed pivotally in the main arms, and the other ends fixed pivotally in the base.

The driving system of the screw in the screw jack comprises an engine, which drives the nut of the scissors jack by means of gear transmission; and in the gear transmission a small wheel is positioned on the engine pivot, and the big wheel is joined coaxially with the nut of the screw jack.

It is good when the engine of the driving system of the screw jack is an electric engine.

It is preferable when in the driving system of the screw jack two engines are used, simultaneously geared with a gear wheel of the nut of the screw jack.

It is good when these driving engines are electric engines.

The screw of the screw jack is attached to the main arms by means of a bed fixed pivotally in the main arms of the scissors system.

The folded jack according to the invention has a form of a thin flat block; it is characterized by a big universality and allows a user of the wheelchair to undertake more activities than in the known solutions. The disabled person may regulate the height of the seat base and have easy access to the table—the legs freely fit under the table top. The jack may also have other applications in industry, for example in transport or production lines.

BRIEF DESCRIPTION OF THE DRAWINGS

The subject of the invention has been presented in an embodiment shown on the illustrations.

DETAILED DESCRIPTION

Figure 1:
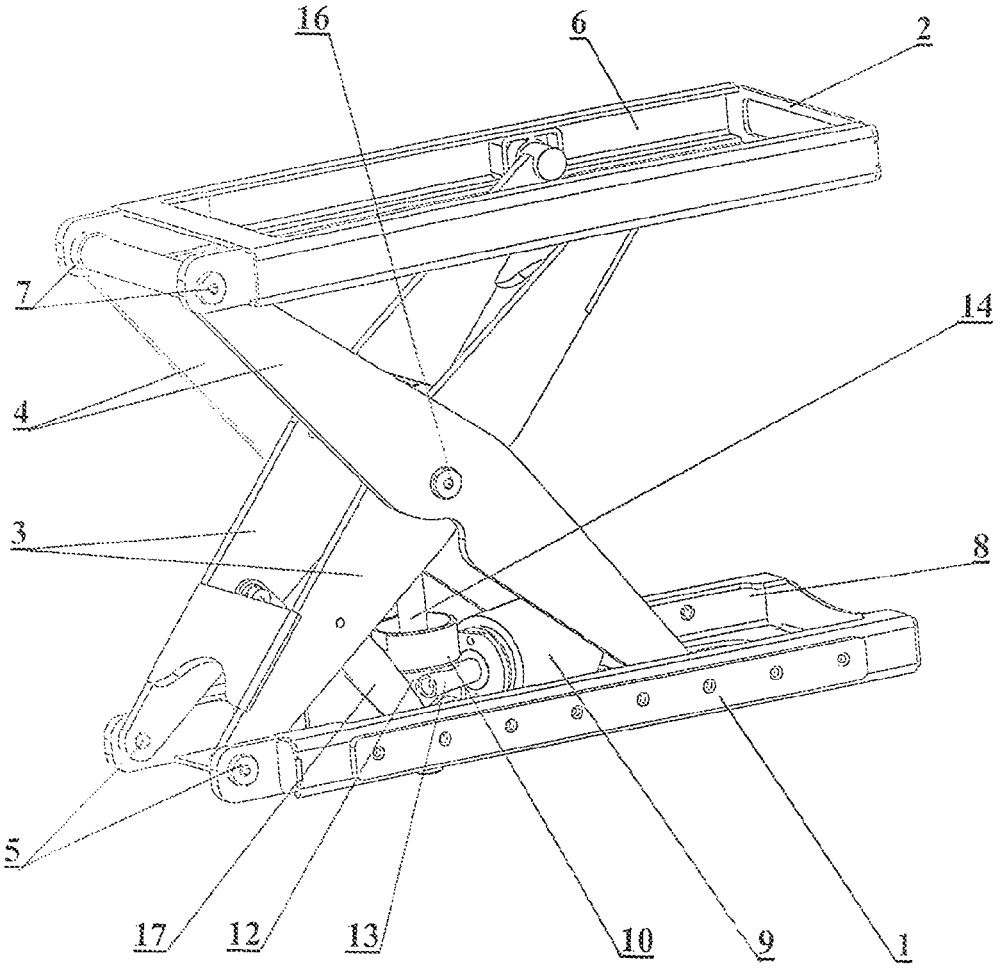
FIG. 1 is an axonometric view of the jack with the raised upper frame.
Figure 2:
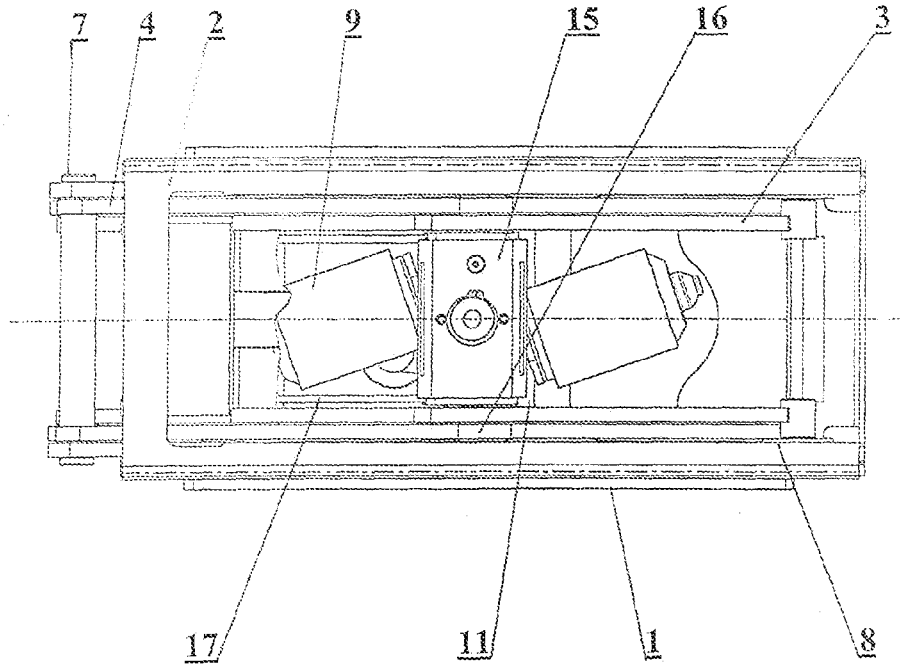
FIG. 2 is a plan view of the jack.
Figure 3:
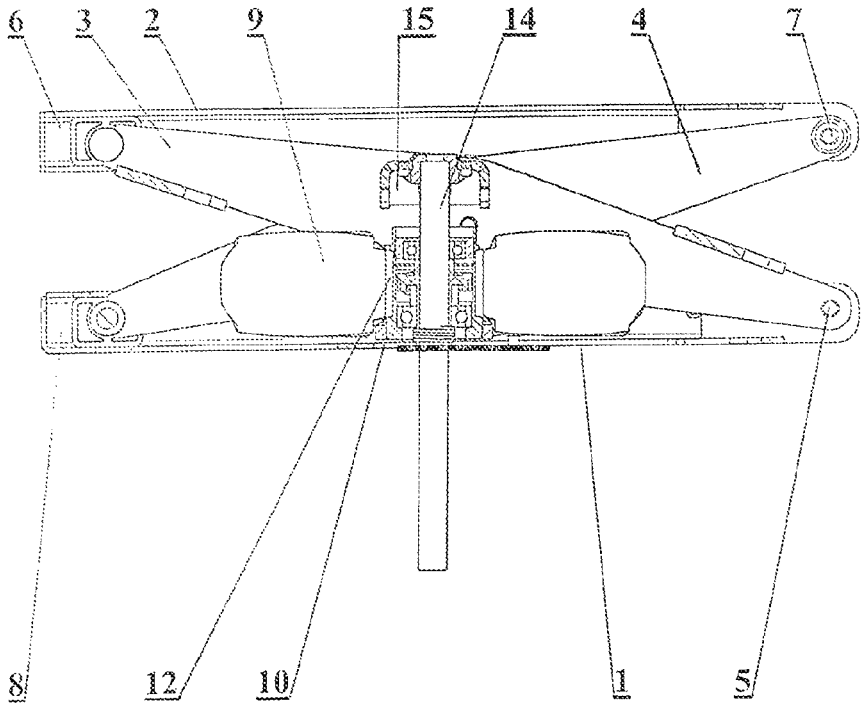
FIG. 3 shows a vertical section of the folded jack through the axis of the screw jack.

As it is shown in FIG. 1 the jack according to the invention comprises the lower frame 1 and the upper frame 2. Frames 1 and 2 are joined by a scissors system, in which the first ends of a pair of main arms 3 are pivotally attached to bolts 5 in the lower frame 1, and the other ends are fixed slideably in the track 6 in the upper frame 2; the other pair of arms of the scissors system is auxiliary arms 4, the upper ends of which are pivotally attached to bolts 7 in the upper frame 2, and the lower ends are fixed slideably in the track 8 in the upper frame 1. In the same track 8 of the lower frame 1 there is slideably planted the base 11 of the driving system of the screw jack. The sliding movement of the base 11 is forced by arms 17 fixed pivotally in the main arms 3 and the base 11 of the driving system. As it is shown in FIG. 2 and FIG. 3, in this embodiment the driving system comprises two electric engines 9 and the nut 10, fixed pivotally in the base 11 of the driving system. The nut 10 is permanently joined with a big gear wheel 12, which is driven by gear wheels 13 attached to shafts of driving engines 9. As it is shown in FIG. 3, in the nut 10 there is fixed the screw 14 of the screw jack, and the other end of the screw is attached to the main arms 3 of the scissors system. The screw 14 is always placed vertically, so that the lifting force is perpendicular to the lower frame 1 and the upper frame 2. The screw 14 is fixed pivotally in the bed 15, which in turn is fixed pivotally in the main arms 3 of the scissors system. The location of the fixing point of the bed 15 in the main arms 3 influences the size of forces in the lifting system—the bigger the distance from the pivoting axis 5 of the main arms 3 in the lower frame, the smaller the lifting force, and the length of screw 14 is increasing. It is most preferable when the fixing point of the bed 15 in the main arms 3 is in the vicinity of axis 16 of the scissors jack.

The functioning of the jack results from its construction: when it is necessary to lift the seat base (attached to the upper frame 2 and not shown on the illustration), the driving engines 9 are started, the gear wheels 13 attached to shafts of engine 9 drive a big gear wheel 12 permanently fixed to the nut 10; the nut 10 starts turning and the screw 14 turns out of the nut 10 and opens the main arms 3; consequently, auxiliary arms 4 open and the upper frame 2 goes upwards. The scissors system keeps the upper frame 2 permanently in a horizontal position; and as the driving system is placed on the sliding base 11, the screw 14 of the screw jack is always in a vertical position, which guarantees the most favorable directions of the acting of forces in the jack.

The jack is folded by reversing the direction of revolutions of the driving engines 9: then the screw 14 goes into the nut 10 and the jack is folded into a flat block

The invention claimed is:

1. A jack for changing of a position of a seat base in a wheelchair, comprising of a fixed lower frame and a movable upper frame connected with the lower frame, with a scissors lifting system whose arms join the lower frame with the upper frame, characterized by the fact that in the lower frame a driving system of a screw jack with a vertical screw is fixed; and an upper end of the screw is pivotally fixed in main arms of the scissors system, and characterized by the fact that the driving system of the screw of the screw jack is fixed to a base attached slideably to the lower frame in tracks in such a way that the screw is permanently in a perpendicular position to the lower frame and the upper frame with maximum deviation of ±10°; and the base is driven by arms, with their first ends fixed pivotally in the main arms, and the other ends fixed pivotally in the base.

2. A jack for the change of a position of a seat base in a wheelchair, comprising of a fixed lower frame and a movable upper frame connected with the lower frame, with a scissors lifting system whose arms join the lower frame with the upper frame, characterized by the fact that in the lower frame a driving system of a screw jack with a vertical screw is fixed; and an upper end of the screw is pivotally fixed in main arms of the scissors system, characterized by the fact that the driving system of the screw of the screw jack comprises an engine, which drives a nut of the screw jack by a gear transmission, and in the gear transmission a small wheel is positioned on an engine pivot, and a big wheel is joined coaxially with the nut.

3. The jack according to the claim 1, characterized by the fact that the screw of the screw jack is fixed to the main arms by a bed fixed pivotally in the main arms of the scissors system.

4. The jack according to the claim 2, characterized by the fact that the engine is an electric engine.

5. A jack for the change of a position of a seat base in a wheelchair, comprising of a fixed lower frame and a movable upper frame connected with the lower frame, with a scissors lifting system whose arms join the lower frame with the upper frame, characterized by the fact that in the lower frame a driving system of a screw jack with a vertical screw is fixed; and an upper end of the screw is pivotally fixed in main arms of the scissors system, characterized by the fact that in the driving system of the screw jack two engines are used, simultaneously geared with a gear wheel of a nut.

6. The jack according to the claim 5, characterized by the fact that the two engines are electric engines.

* * * * *